United States Patent [19]

Gould

[11] Patent Number: 4,509,338

[45] Date of Patent: Apr. 9, 1985

[54] CONDENSATION ELIMINATION TANK

[76] Inventor: Eugene J. Gould, Village of Newhaven #613, Fripp Island, S.C. 29920

[21] Appl. No.: 607,749

[22] Filed: May 7, 1984

[51] Int. Cl.[3] ..... F25D 21/14

[52] U.S. Cl. ..... 62/288; 62/291

[58] Field of Search ..... 62/279, 285, 288, 291

[56] References Cited

U.S. PATENT DOCUMENTS 2,130,930 9/1938 Rose ..... 62/291 X 3,199,307 8/1965 Willis ..... 62/285 X

*Primary Examiner*—William E. Wayner

*Assistant Examiner*—John Sollecito

*Attorney, Agent, or Firm*—Larry Harold Kline

[57] ABSTRACT

A method and device are disclosed for eliminating condensation on condensate drainage piping located in a warm attic-type atmosphere caused by cold condensate water emanating from the indoor section, including an air handler, of an air-conditioning system comprising an external shell; first and second connections from the external shell; flow restricting apparatus within the external shell operative to impede the flow of the cold condensate water; and a reservoir formed from the cold condensate water which has been warmed and deposited within the external shell, the reservoir being further heated by the warm attic-type atmosphere; and emptying the excess reservoir water into the condensate drainage piping at a temperature whereby the condensate drainage piping will be free from condensation.

10 Claims, 6 Drawing Figures

CONDENSATION ELIMINATION TANK

This invention relates to a method and device for eliminating condensation damage and more particularly to a method and device to eliminate condensation damage from drain lines located in attic-type areas.

Water that comes off of evaporator coils of an air-conditioning unit is cold in comparison to the temperature of the attic-type area through which the drain lines extend. The difference in temperature causes condensation to form on the exterior of the drain lines. This condensation dripping off the drain lines can ruin ceilings, insulation, drywalls, and cause extensive damage to a structure. Even if insulation surrounds the drain lines, the insulation may become saturated with condensation and eventually leak, causing similar damage. The present invention heats the condensate water from the evaporator coils of the air-conditioning unit, thereby eliminating the condensation forming on the exterior of the drain lines and preventing the potential damage to the structure.

An object of the present invention is to eliminate condensation forming on the drain lines of an air-conditioning unit by heating the condensate water which comes from the evaporator coils of an air-conditioning unit.

Another object of the present invention is to raise the temperature of the condensate water from the evaporator coils of an air-conditioning unit to a temperature where condensation will not form on the drain lines.

Still another object of the present invention is to prevent the necessity and expensive of utilizing insulation on the drain lines extending from an air handler of an air-conditioning unit.

A further object of the present invention is to eliminate the possibility of damage to ceilings, insulation, and drywalls of a structure by preventing condensation from forming on the drain lines extending from an air handler of an air-conditioning unit.

Another object of the present invention is to provide a method and device for eliminating condensation forming on the drain lines of an air handler of an air-conditioning unit which will not effect the operation of the air handler when the air-conditioning unit is utilized as a heating unit.

These and other objects and features of the invention will be apparent from the following description and appended claims.

Briefly, the invention is a device for eliminating condensation on condensate drainage piping located in a warm attic-type atmosphere caused by cold condensate water emanating from the indoor section, including an air handler, of an air-conditioning system. The device comprises an external shell, first and second end connections, and flow restricting means. The first end connection connects the external shell to the indoor section, including an air handler, of an air-conditioning system. The second end connection connects the external shell to the condensate drainage piping. The flow restricting means is secured within the external shell and is operative to impede the flow of the cold condensate water.

The device further comprises a reservoir. The reservoir comprises the cold condensate water which has been heated by the warm attic-type atmosphere as the cold condensate water has been impeded by the flow restricting means to become warmed water. The warmed water has been deposited at the bottom of the external shell where the warmed water has been further heated by the warm attic-type atmosphere to become the reservoir. When more of the cold condensate water emanates from the indoor section, including the air handler, of an air-conditioning system, the reservoir will overflow causing a portion of the reservoir to empty into the condensate draining piping at a temperature whereby the condensate drainage piping will be free from condensation.

The flow restricting means comprises a drainage trough, a flow restrictor, and support means. The drainage trough is secured within the external shell and is rigidly connected to the first end connection. The drainage trough is operative to impede the flow of the cold condensate water before the cold condensate water contacts the external shell. The flow restrictor is secured to the end of the drainage trough and is operative to further impede the flow of the cold condensate water. The support means is secured within the external shell and is operative to rigidly secure the drainage trough isolated from the external shell.

The device may be dark in color to aid the absorption of heat within the device from the warm attic-type atmosphere. The device may be mounted horizontally to the indoor section, including an air handler, of an air-conditioning system, whereby the reservoir will maintain maximum depth prior to overflowing.

The invention is a method for eliminating condensation on condensate drainage piping located in a warm attic-type atmosphere caused by cold condensate water emanating from the indoor section, including an air handler, of an air-conditioning system. The method comprises securing the device to the drain connector of the indoor section, including an air handler, of an air-conditioning system, restricting the flow of the cold condensate water within the external shell by use of flow restricting means, heating the cold condensate water by the warm attic-type atmosphere to become warmed water while the flow of the cold condensate water is being restricted by the flow restricting means, depositing the warmed water at the bottom of the external shell to form a reservoir, further heating the reservoir with heat from the warm attic-type atmosphere, and emptying a portion of the reservoir into the condensate drainage piping at a temperature whereby the condensate drainage piping will be free from condensation when sufficient cold condensate water has entered the device to cause the reservoir to overflow.

The invention will be more fully understood from the following detailed description and appended claims when taken with the drawings in which:

Figure 1:
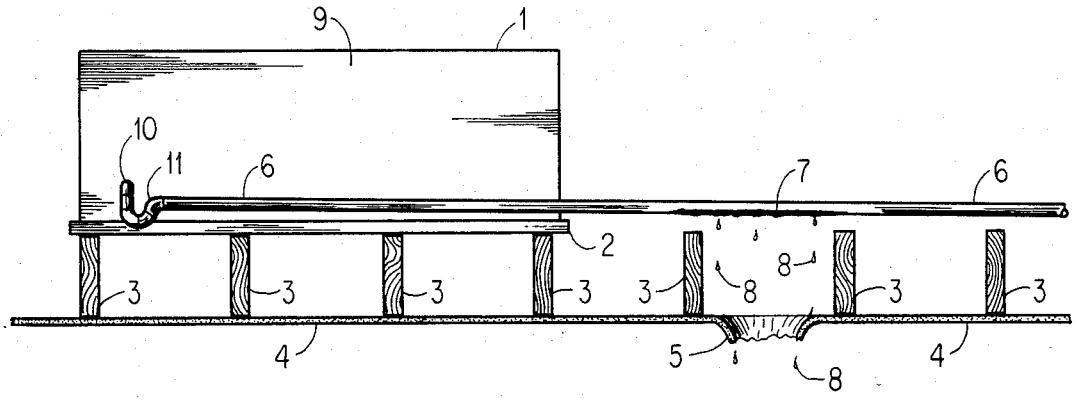
PRIOR ART FIG. 1
FIG. 1 is a schematic representation of an indoor section, including an air handler, of an air-conditioning system in an attic without the present invention installed and showing possible ceiling damage from dripping condensation.

Referring now to the drawings, FIG. 1 is a schematic representation of an indoor section, including an air handler, of an air-conditioning system in an attic without the present invention installed and showing possible ceiling damage from dripping condensation. Auxiliary drain pan 2 is placed below the indoor section, including air handler 1. In the attic area are attic floor structure members 3. The evaporator coils within the indoor section, including air handler 1, of an air-conditioning system will cause cold condensate water to drain from the indoor section, including air handler 1. The cold water will flow into the condensate drain connection 10 and into the condensate drain line trap 11. The condensate drain connection 10 is located on the side 9 of the indoor section, including air handler 1, of an air-conditioning system. The cold water will then flow through the condensate drainage piping 6. As the cold water flows through the condensate drainage piping 6, condensation 7 will form on the exterior of the condensate draining piping 6. The dripping condensation 8 can drip onto ceiling material 4. The dripping condensation 8 can cause the ceiling material 4 to become a water-damaged area 5. This dripping condensation 8 can cause damage to ceilings, insulation, drywalls, and cause other extensive damage throughout the structure. The present invention eliminates this water damage.

Figure 2:
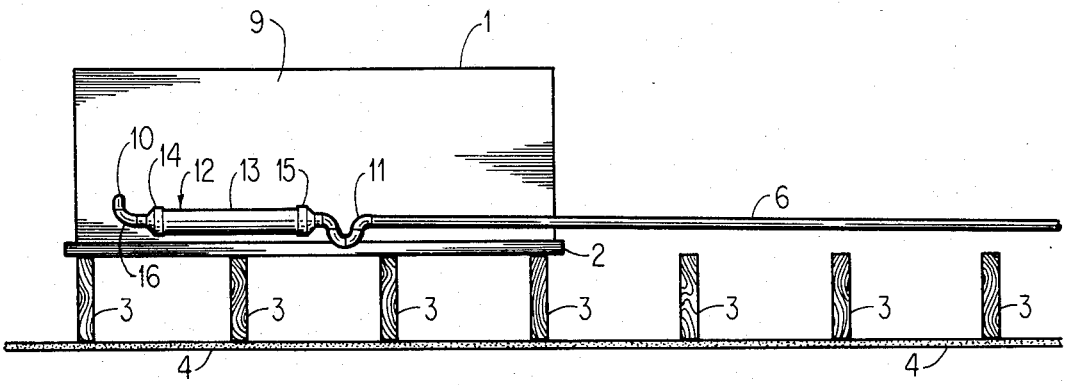
FIG. 2 is a schematic representation of an indoor section, including an air handler, of an air-conditioning system in an attic with device 12 attached indicating no ceiling damage due to an absence of condensation.

FIG. 2 is a schematic representation of an indoor section, including an air handler, of an air-conditioning system in an attic with device 12 attached indicating no ceiling damage due to an absence of condensation. Condensate drain connection 10 is connected directly to device 12. Device 12 has an end connector 14 connecting device 12 to condensate drain connection 10 by elbow 16. Device 12 has an end connection 15 connecting device 12 to condensate drain line trap 11. Device 12 has an external shell 13.

As shown by the illustrative FIG. 2, no dripping condensation 8 drips from condensate drainage piping 6, thereby eliminating damage to the structure. No water lands on ceiling material 4 to cause the water-damaged area 5 as shown in FIG. 1.

Figure 3:
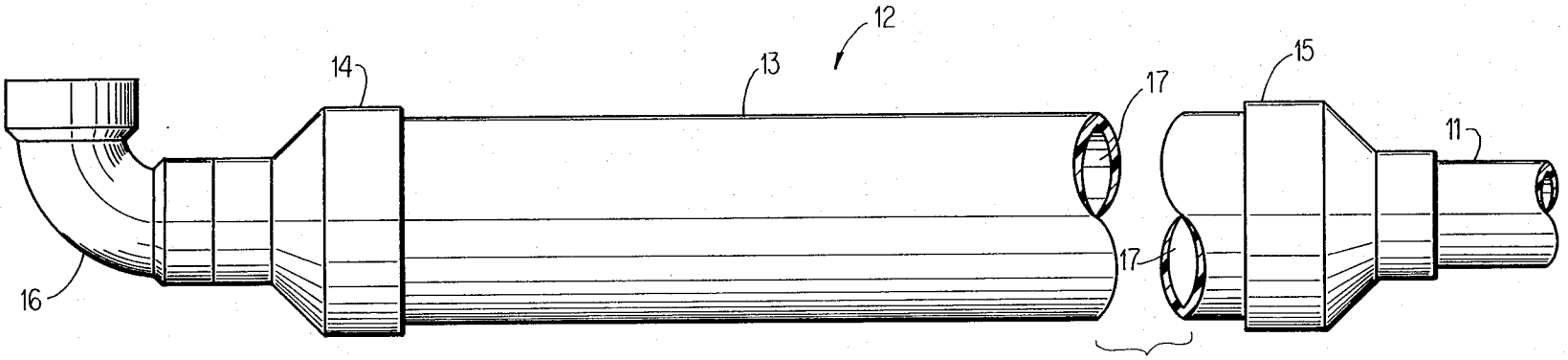
FIG. 3 is an enlarged elevational view of device 12.

FIG. 3 is an enlarged elevational view of device 12. The external shell 13 has an interior portion 17. End connection 14 connects the device 12 to elbow 16. Elbow 16 may be what is called a vertical elbow in order to position device 12 in a horizontal position.

Figure 4:
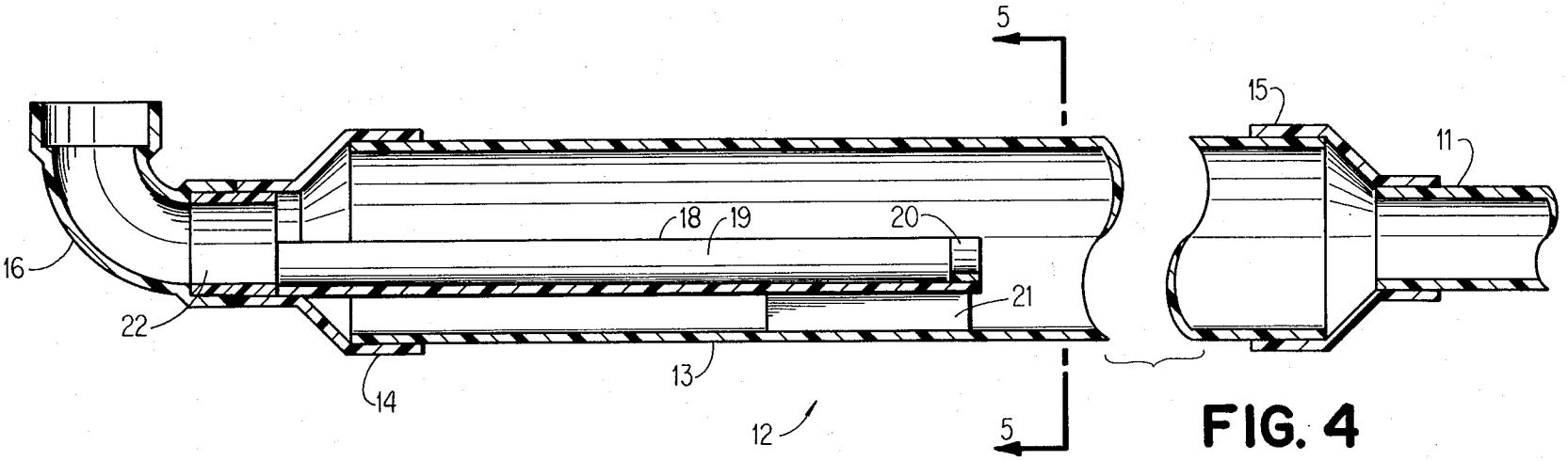
FIG. 4 is a longitudinal sectional view of device 12 taken at section 4—4 shown in FIG. 5.
Figure 5:
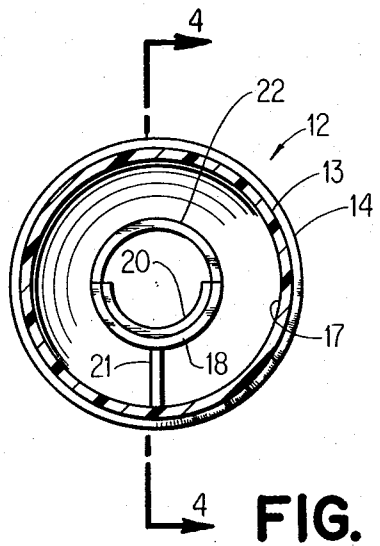
FIG. 5 is a cross-sectional view of device 12 taken at section 5—5 of FIG. 4.

FIG. 4 is a longitudinal sectional view of device 12 taken at section 4—4 shown in FIG. 5. Device 12 has an internal drainage trough 18. Internal drainage trough 18 has an inside surface 19. At the end of the internal drainage trough 18 is a flow restrictor 20. Internal drainage trough 18 is supported by a trough support 21. Internal connector 22 fits within the connection of end connector 14 to elbow 16, allowing for a smooth flow from the elbow 16 into the internal drainage trough 18.

FIG. 5 is a cross-sectional view of device 12 taken at section 5—5 of FIG. 4. As shown in FIG. 5, the internal connector 22 forms a smooth connection with internal drainage trough 18 so that the cold water will flow smoothly into the internal drainage trough 18 without the possibility of leakage. Flow restrictor 20 impedes the flow of the cold water.

Figure 6:
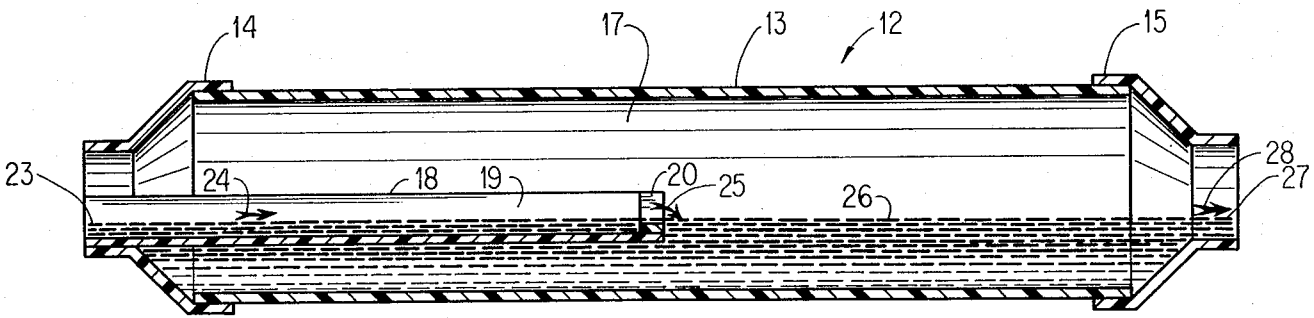
FIG. 6 is a sectional view of device 12 showing condensate water 26 therein.

FIG. 6 is a sectional view of device 12 showing condensate water 26 therein. The cold condensate water 23 flows on path 24 into internal drainage trough 18. Flow of cold condensate water 23 is impeded by the flow restrictor 20. As the cold condensate water 23 increases in amount, the cold condensate water 23 flows over the flow restrictor 20 on path 25. The cold condensate water 23 flows into the interior 17 of device 12.

Device 12 is located in a hot attic-type atmosphere, thereby causing the cold condensate water 23 to become heated water reservoir 26. As the device 12 operates, a heated water reservoir 26 will remain within the device 12. As the water level rises, the overflow 27 of heated water reservoir 26 will flow on path 28 from the device 12 and into the condensate drain line trap 11 and through the condensate drainage piping 6, as shown in FIG. 2.

As the cold condensate water 23 enters internal drainage trough 18, the cold condensate water 23 flows over the surface 19 of internal drainage trough 18. Due to the location of the device 12 in a hot attic-type atmosphere, heat will be absorbed within the interior 17 of device 12. This absorbed heat will heat the cold condensate water 23 as the cold condensate water 23 flows across the inside surface 19 of internal drainage trough 18. Therefore, as the cold condensate water 23 flows over flow restrictor 20 along path 25 and into the heated water reservoir 26, the condensate water has already been preliminarily heated by the hot attic-type atmosphere. The length of the internal drainage trough 18, along with the flow restrictor 20, impedes the flow of the condensate water 23, thereby allowing the condensate water 23 to be initially heated and preventing the device 12 from having exterior condensation problems.

The internal drainage trough 18 may be shaped in any desired manner. Illustrated in the drawings is a basic configuration of a length of half a cylinder. One advantage of having an open trough as the internal drainage trough 18 is that the heated atmosphere within the interior 17 of device 12 can act directly onto the cold condensate water 23 to aid in initially heating the cold condensate water 23.

Device 12 causes the cold condensate water 23 to pool or form a reservoir 26 within the device 12 while being heated by the hot attic-type atmosphere. The cold condensate water 23 begins the warming process in the internal drainage trough 18. The length of the internal drainage trough 18 slows down the flow of the cold condensate water 23 before the cold condensate water 23 makes contact with the external shell 13 of device 12. The flow restrictor at the end of the internal drainage trough 18 helps to impede the flow of the cold condensate water 23. The cold condensate water 23 becomes heated in the internal drainage trough 18 and will spill over into the interior 17 and pool as heated water reservoir 26. With the addition of more condensate water 23 into the device, heated water will flow out of reservoir 26 along path 28 into drain trap 11 and then into drainage piping 6.

The present method and device allows the condensate water from the evaporator coils of an air-conditioning system to be heated by the hot attic-type atmosphere. Raising the temperature of this condensate water prevents condensation from forming on the drain lines of the air-conditioning system, which prevents damage from condensation to ceilings, insulation, and drywalls. The present method and device also prevents the necessity and expense of utilizing insulation on the drain lines of an air-conditioning system. The present method and device will not effect the operation of the air handler when the air-conditioning system is utilized as a heating unit.

The device 12 may be made from any desired material, including PVC plastic pipe. The device 12 may be any desired color, but may be painted a dark color such as black to aid in absorbing heat from the attic-type atmosphere.

The device 12 may be mounted as horizontally as possible to retain the maximum amount of heated water in reservoir 26. The internal drainage trough 18 may be of any length or shape desired. The internal drainage trough 18 may be supported in any manner desired. The flow of the condensate water may be impeded by flow restrictor 20 or by any means desired.

Device 12 is extremely light and may be supported simply by the connections to the condensate drain line trap 11 and condensate drainage piping 6 and the connections to the indoor section, including air handler 1, of the air-conditioning system. If desired, device 12 could be mounted with brackets.

The device 12 may be any length or shape desired. The connections between device 12 and the indoor section, including air handler 1, of the air-conditioning system and the condensate drainage piping 6 may be any desired connectors. The device 12 may be utilized with any desired air-conditioning system, but is most desirable with a unit which has an air handler and which is located above potentially damagable structural areas. The device 12 is a condensation elimination tank for eliminating condensation on the outside of condensate drain lines of air-conditioning systems.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for eliminating condensation, on condensate drainage piping located in a warm attic-type atmosphere, caused by cold condensate water emanating from the indoor section, including an air handler, of an air-conditioning system comprising:

a. a cylindrical external shell b. a first end connection comprised of a reducing bushing connecting said cylindrical external shell's first end directly to said indoor section, including said air handler, of said air-conditioning system;

c. a second end connection comprised of a reducing busing connecting said cylindrical external shell's second end directly to said condensate drainage piping;

d. flow restricting means secured within said cylindrical external shell and operative to impede the flow of said cold condensate water, said flow restricting means comprising a drainage trough secured within said cylindrical external shell and rigidly connected to said first end connection and operative to impede the flow of said cold condensate water before said cold condensate water contacts said cylindrical external shell; and e. a reservoir comprising cold condensate water which has been heated by said warm attic-type atmosphere as said cold condensate water has been impeded by said flow restricting means to become warmed water, which has been deposited at the bottom of said cylindrical external shell where said warmed water has has been further heated by said warm attic-type atmosphere to become said reservoir, whereby when more of said cold condensate water emanates from said indoor section, including said air handler, of said air-conditioning system, said reservoir will overflow causing a portion of said reservoir to empty into said condensate drainage piping at a temperature whereby said condensate drainage piping will be free from condensation.

2. A device according to claim 1 wherein said flow restricting means further comprises a flow restrictor secured to the end of said drainage trough and operative to further impede the flow of said cold condensate water.

3. A device according to claim 1 wherein said flow restricting means further comprises support means secured within said cylindrical external shell and operative to rigidly secure said drainage trough isolated from said external shell.

4. A device according to claim 1 wherein said device is dark in color to aid the absorption of heat within said device from said warm attic-type atmosphere.

5. A device according to claim 1 wherein said device is mounted horizontally to said indoor section, including said air handler, of said air-conditioning system whereby said reservoir will maintain maximum depth prior to overflowing.

6. A method for eliminating condensation, on condensate drainage piping located in a warm attic-type atmosphere, caused by cold condensate water emanating from the indoor section, including an air handler, of an air-conditioning system comprising:

a. securing to the drain connector of said indoor section, including said air handler, of said air-conditioning system a device comprising:

(1) a cylindrical external shell (2) a first end connection comprised of a reducing bushing connecting said cylindrical external shell's first end directly to said indoor section, including said air handler, of said air-conditioning system: and (3) a second end connection comprised of a reducing bushing connecting said cylindrical external shell's second end directly to said condensate drainage piping;

b. restricting the flow of said cold condensate water within said cylindrical external shell by use of flow restricting means comprising a drainage trough secured within said cylindrical external shell and rigidly connected to said first end connection and operative to impede the flow of said cold condensate water before said cold condensate water contacts said cylindrical external shell;

c. heating said cold condensate water by said warm attic-type atmosphere to become warmed water, while the flow of said cold condensate water is being restricted by said flow restricting means;

d. depositing said warmed water at the bottom of said cylindrical external shell to form a reservoir;

e. further heating said reservoir with heat from said warm attic-type atmosphere; and f. emptying a portion of said reservoir into said condensate drainage piping at a temperature whereby said condensate drainage piping will be free from condensation, when sufficient cold condensate water has entered said device to cause said reservoir to overflow.

7. A method according to claim 6 wherein said flow restricting means further comprises a flow restrictor secured to the end of said drainage trough and operative to further impede the flow of said cold condensate water.

8. A method according to claim 6 wherein said flow restricting means further comprises support means secured within said cylindrical external shell and operative to rigidly secure said drainage trough isolated from said cylindrical external shell.

9. A method according to claim 6 wherein said device is dark in color to aid the absorption of heat within said device from said warm attic-type atmosphere.

10. A method according to claim 6 wherein said device is mounted horizontally to said indoor section, including said air handler, of said air-conditioning system whereby said reservoir will maintain maximum depth prior to overflowing.

* * * * *